US005673675A

United States Patent [19]

Wada et al.

[11] Patent Number: 5,673,675

[45] Date of Patent: Oct. 7, 1997

[54] VERTICAL-TYPE MULTICYLINDER ENGINE HAVING A BLOW-BY GAS RETURNING STRUCTURE

[75] Inventors: Tetu Wada; Kouichi Oka, both of Wako, Japan

[73] Assignee: Honda Giken Kogyo Kabushiki Kaisha, Tokyo, Japan

[21] Appl. No.: 536,949

[22] Filed: Sep. 29, 1995

[30] Foreign Application Priority Data

Sep. 29, 1994 [JP] Japan ..... 6-235432

[51] Int. Cl.[6] ..... F02M 35/12; F01M 13/00

[52] U.S. Cl. ..... 123/572

[58] Field of Search ..... 123/572, 573, 123/574, 195 HC

[56] References Cited

U.S. PATENT DOCUMENTS

| | | | |
|---|---|---|---|
| 4,881,510 | 11/1989 | Etoh et al. | 123/572 |
| 5,383,440 | 1/1995 | Koishikawa et al. | 123/572 |
| 5,488,939 | 2/1996 | Nakai et al. | 123/572 |
| 5,501,202 | 3/1996 | Watanabe | 123/572 |

FOREIGN PATENT DOCUMENTS 4-001661 1/1992 Japan .

*Primary Examiner*—Marguerite McMahon

*Attorney, Agent, or Firm*—Merchant, Gould, Smith, Edell, Welter & Schmidt P.A.

[57] ABSTRACT

A vertical-type multicylinder engine includes a plurality of combustion chambers, an inlet muffler having a plurality of air intake passages, and a blow-by gas entry opening for introducing blow-by gas into the muffler, and a plurality of throttle valve devices provided downstream of the intake passages and upstream of the valve devices in corresponding relation thereto. The inlet muffler has a plurality of blow-by gas distributing paths that are formed inside the muffler to distributively direct the blow-by gas introduced via the blow-by gas entry opening to the corresponding throttle valve devices. Thus, the entry opening, distributing paths and intake passages of the muffler and the throttle valve devices together define a structure for returning the blow-by gas to an upstream portion of the engine intake system. The distributing paths have different sizes that become progressively greater as the respective distances, from the blow-by gas entry opening, of the paths increase. The blow-by gas returning structure thus formed serves to minimize inter-cylinder differences in the amounts of blow-by gas flowing into the individual throttle valve devices and hence in combustion conditions in the combustion chambers.

8 Claims, 6 Drawing Sheets

VERTICAL-TYPE MULTICYLINDER ENGINE HAVING A BLOW-BY GAS RETURNING STRUCTURE

BACKGROUND OF THE INVENTION

1. Field of the Invention

The present invention relates to a vertical-type multicylinder engine having a blow-by gas returning structure which achieves minimized inter-cylinder differences in combustion conditions.

2. Description of the Related Art

Generally, when a vertical-type multicylinder engine employed as in an outboard engine unit is in operation, a portion of a combusted gas leaks from individual combustion chambers through slight gaps between the respective pistons and cylinders and then accumulates in a cylinder block, causing significant adverse effects on the performance of the engine.

To this end, a blow-by gas returning structure has been proposed in, for example, Japanese Utility Model Laid-Open Publication No. HEI 4-1661, which is designed to return or recirculate the leaked blow-by gas from the cylinder block to the combustion chambers via an air intake system of the engine. More specifically, this blow-by gas returning structure allows the leaked blow-by gas to be fed from the cylinder block back to the combustion chambers via a box-shaped inlet muffler (silencer) of the intake system so that the leaked blow-by gas may be subjected to re-combustion in the combustion chambers.

In such a proposed multicylinder engine, when the blow-by gas is returned from the cylinder block to the intake system, however, the amounts of the blow-by gas flowing into a plurality of throttle valve devices would considerably differ from one throttle valve device to another, so that the gas densities in the air flowing into the individual throttle valve devices would become non-uniform, thus resulting in undesirable different combustion conditions in the combustion chambers.

It is therefore an object of the present invention to provide a vertical-type multicylinder engine having a blow-by gas returning structure which allows a blow-by gas to flow in uniform amounts into a plurality of throttle valve devices of the engine, to thereby minimize inter-cylinder differences in combustion conditions.

SUMMARY OF THE INVENTION

A vertical-type multicylinder engine in accordance with the present invention comprises a plurality of combustion chambers, an inlet muffler having a plurality of air intake passages, a blow-by gas entry opening for introducing blow-by gas into the muffler, and a plurality of throttle valve devices disposed downstream of the intake passages and upstream of the combustion chambers in corresponding relationship thereto. The inlet muffler has a plurality of blow-by gas distributing paths formed inside the muffler in correspondence to the throttle valve devices for allowing the blow-by gas introduced via the entry opening to distributively flow therethrough to the corresponding throttle valve devices. In this way, the entry opening, distributing paths and intake passages of the muffler and the throttle valve devices jointly define a structure for returning the blow-by gas upstream of the combustion chambers.

In one preferred implementation, the distributing paths are formed by a plurality of intercepting plates that are provided in spaced apart relationship to each other inside the muffler so that gaps between every two adjacent plates define the distributing paths. Alternatively, the distributing paths may be formed by a single intercepting plate having a plurality of holes formed therein so that the holes define the distributing paths.

Further, in a most preferred implementation, the distributing paths have different sizes that become progressively greater as the respective distances from the blow-by gas entry opening of the paths increase. This arrangement effectively prevents the blow-by gas introduced into the muffler from flowing concentratedly through one of the paths which is closest to the entry opening and thereby permits uniform amounts of the blow-by gas to flow through the individual blow-by gas distributing paths. Thus, the blow-by gas introduced into the muffler, while flowing along the intercepting plate or plates, is distributed through the paths into the corresponding throttle valve devices in substantially uniform amounts.

BRIEF DESCRIPTION OF THE DRAWINGS

Embodiments of the present invention will now be described, by way of example only, with reference to the accompanying drawings, in which.

DETAILED DESCRIPTION OF THE PREFERRED EMBODIMENTS

Figure 1:
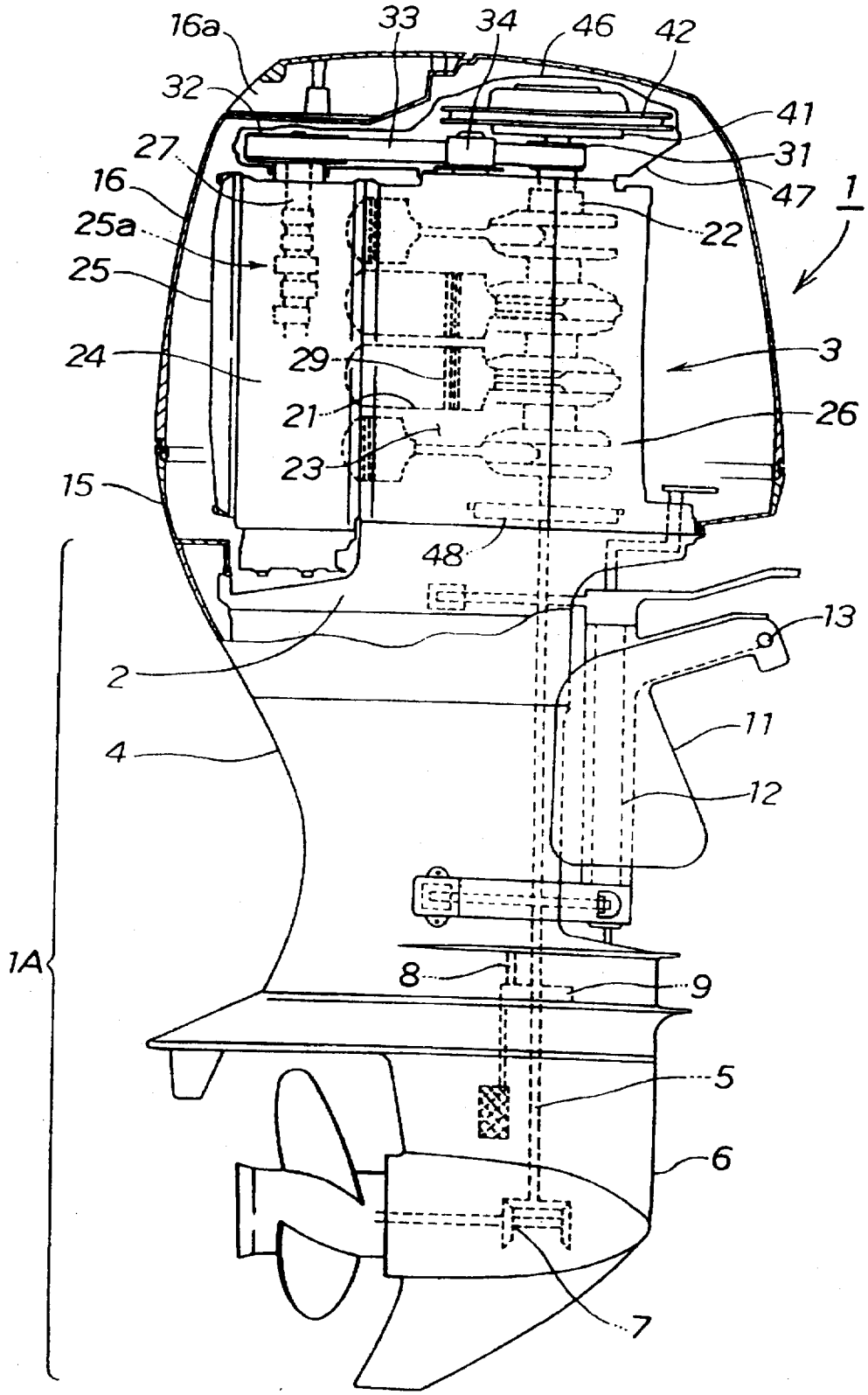
FIG. 1 is a schematic side view, partially in section, showing an essential part of an outboard engine unit which contains a vertical-type multicylinder engine according to the present invention.

FIG. 1 is a schematic side view, partially in section, showing an essential part of an outboard engine unit which contains a vertical-type multicylinder engine according to the present invention. As shown, the outboard engine unit 1 generally comprises a vertical-type multicylinder engine 3 placed on and secured by bolt to a mount case 2 serving as an engine mounting member, an extension case 4 secured by bolt to the underside of the mount case 2, a vertical drive shaft 5 accommodated in the extension case 4, a bevel gear set 7 provided within a gear case 6 fastened to the underside of the extension case 4, an outboard engine unit body 1A including a cooling water supply pipe 8 and cooling water pump 9 provided within the extension and gear cases 4 and 6, and an outboard engine unit mounting means 11 that is connected with the unit body 1A and resiliently supports the body 1A via a mount rubber.

More specifically, the outboard engine unit mounting means 11 comprises metal fittings which secure the outboard engine unit 1 to the body of a ship (not shown) in such a manner that the unit body 1A can pivot horizontally about a swivelling shaft 12 and can also pivot together with the swivelling shaft 12 vertically (in the clockwise direction of FIG. 1) about a tilting pivot 13.

The outboard engine unit body 1A also includes an under case 15 and an engine cover 16 detachably attached to the under case 15, which together form an engine room accommodating the engine 3. The under case 15 is supported by the mount case 2. Further, reference numeral 16*a* represents an air inlet that ultimately leads to the intake port of the engine 3.

The vertical-type multicylinder engine 3 is for example a four-cylinder engine, which is disposed in such a manner that the elongate axis of each cylinder 21 lies virtually horizontally and a crank shaft 22 extends vertically. The plane in which cylinder block 23 and cylinder head 24 are attached together lies substantially vertically. Cam shaft 27 and the like are provided within a valve operating chamber 25*a* formed by the cylinder head 24 and head cover 25.

Reference numeral 26 represents a crank case, and reference numeral 29 represents pistons each provided within the corresponding cylinder 21. The crank case 26 is in fluid communication with the valve operating chamber 25*a* via a breather passage.

The upper end portion of the crank shaft 22 projects beyond the cylinder block 23, and the upper end portion of the cam shaft 27 projects beyond the cylinder head 24.

An endless timing belt 33 extending horizontally has opposite ends wound around a crank shaft pulley 31 mounted on the upper end portion of the crank shaft 22 and a cam shaft pulley 32 mounted on the upper end portion of the cam shaft 27. A tensioner 34 is provided to impart appropriate tension to the timing belt 33.

On the upper end portion of the crank shaft 22 outwardly of the timing belt 33 (at one side of the engine 3), a manual starting pulley 42 is mounted with a rotor of an A.C. power generator interposed between the pulley 42 and timing belt 33.

The above-mentioned crank shaft pulley 31, cam shaft pulley 32, timing belt 33, tensioner 34, rotor 41 and manual starting pulley 42 are enclosed by upper and lower belt covers 46 and 47.

Fly wheel 48 is mounted on the lower end portion of the crank shaft 22 (at the other side of the engine 3).

Figure 2:
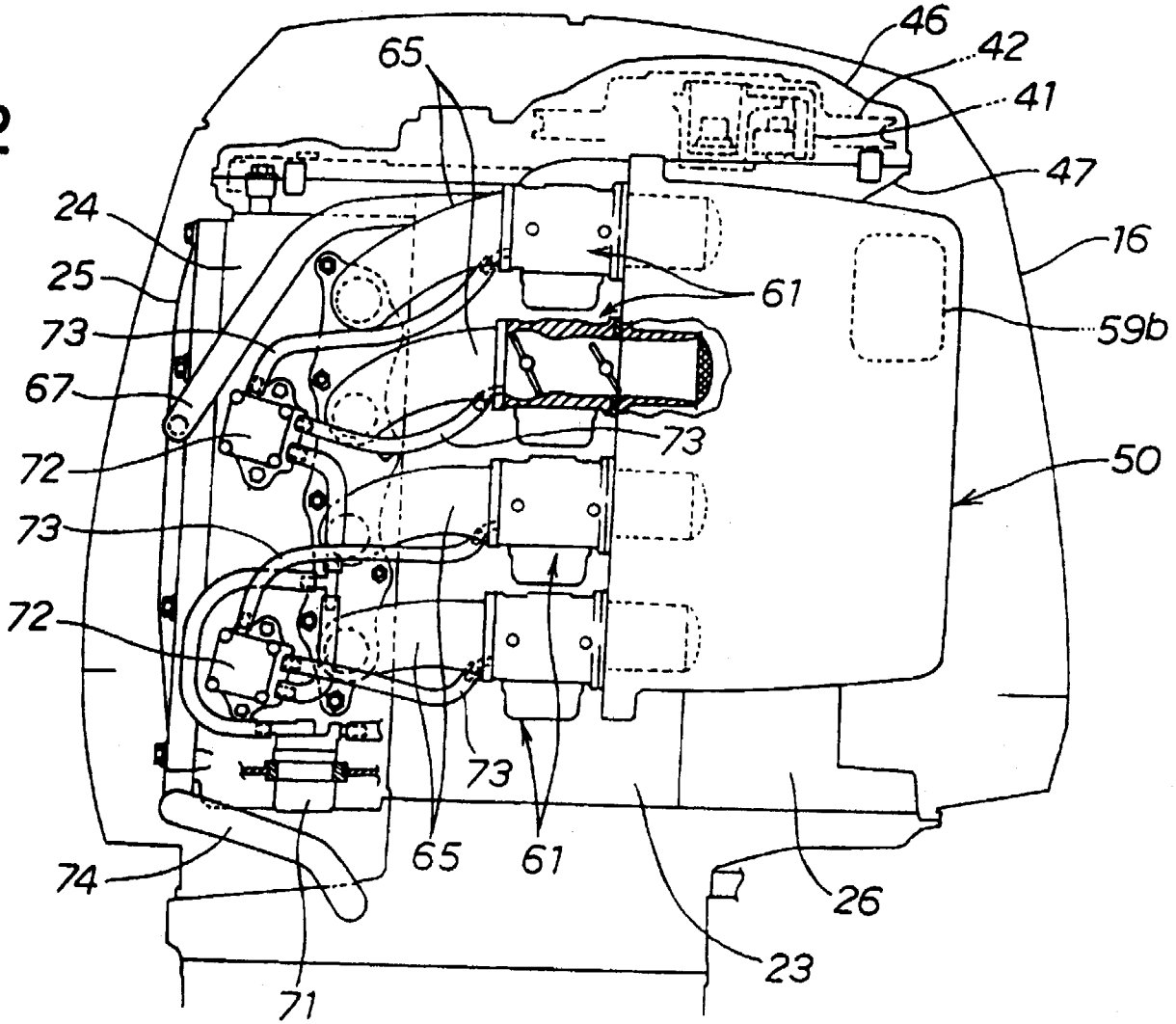
FIG. 2 is a schematic side view, partially in section, showing the multicylinder engine of FIG. 1 in greater detail.

FIG. 2 is a schematic side view, partially in section, showing the engine 3 of FIG. 1 in greater detail. As shown, this engine 3 includes an inlet muffler box 50, and throttle valve devices 61 and intake manifolds 65 which correspond in number to the engine cylinders. The throttle valve devices 61 and branch pipes 65 of the intake manifolds are identical in number to the cylinders. The throttle valve devices 61 are disposed in vertical alignment with each other, and similarly the manifold branch pipes 65 are similarly disposed in vertical alignment with each other.

Reference numeral 59*b* denotes an air inlet of the muffler box 50, 71 a fuel filter, 72 fuel pumps, 73 fuel supply tubes each connecting between one of the fuel pumps 72 and a float chamber of one of the throttle valve devices 61, and 74 an oil drain tube.

Figure 3:
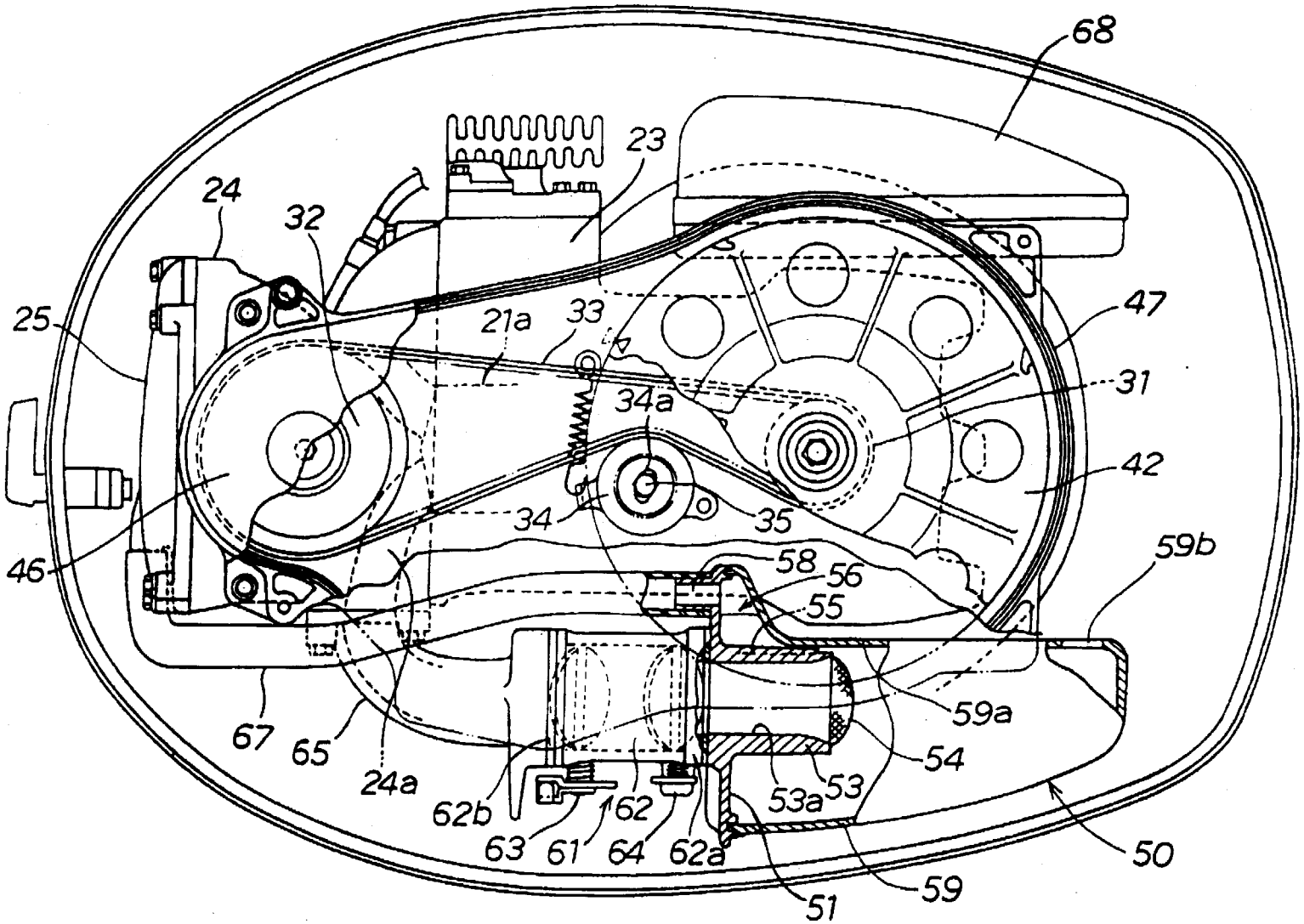
FIG. 3 is a plan view showing the multicylinder engine with its upper cover removed.

FIG. 3 is a plan view showing the engine 3 with its upper cover removed. The tensioner 34 is mounted, by means of a position adjusting bolt 35, on the upper surface of the cylinder block 23, so that the tension of the timing belt 33 can be optionally adjusted by varying the engaging relation between the bolt 35 and an elongate opening 34*a* formed in the tensioner 34.

The inlet muffler box 50 is comprised of a base 51 and an inlet muffling case 59 mounted on the base 51, and the head cover 25 is connected in communication with a connector portion (i.e., blow-by gas entry opening) 58 of the base 51 via a blow-by gas returning tube 67.

Each of the throttle valve devices 61 includes a carburetor 62 and a throttle valve 63 that is attached to the carburetor 62 to variably control the air intake amount. The carburetor's inlet 62*a* is connected with the base 51.

An air-fuel-mixture is supplied from each carburetor's outlet 62*b*, through the corresponding manifold branch pipe 65 and passageway 24*a* within the cylinder head 24, to the corresponding combustion chamber 21*a*.

Reference numerals 64 and 68 represent a choke valve, and a box accommodating an ignition coil and CDI (Condenser Discharge Ignition) unit, respectively.

Figure 4:
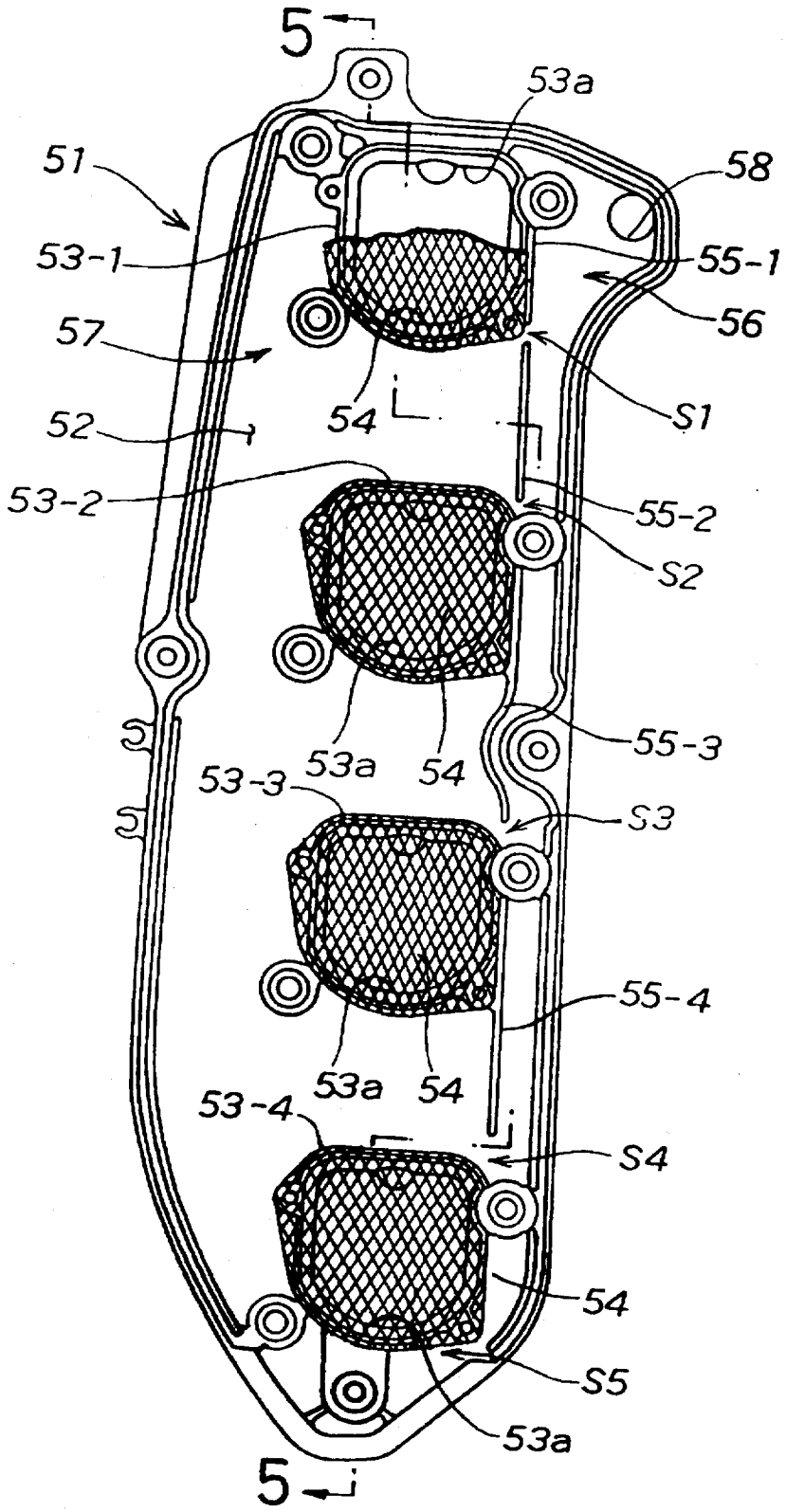
FIG. 4 is a side view showing the inner arrangement of an inlet muffler box of the engine.

FIG. 4 is a side view showing the interior of the muffler box enclosed by the base 51 which is shown here as being elongate in the vertical direction. The base 51 includes a side wall plate 52, four air horns 53-1 to 53-4 that are provided in the plate 52 in vertical alignment with each other and at such locations corresponding to the carburetor inlets 62*a* (FIG. 3), intake passages 53*a* formed in the air horns 53-1 to 53-4, screens 54 attached to the respective air horns 53-1 to 53-4 to cover the intake passages 53*a*, four intercepting plates 55-1 to 55-4 extending vertically along the right side of the air horns 53-1 to 53-4, a right distributing space 56 and left air passage space 57 generally separated from each other by the intercepting plates 55-1 to 55-4, and the connector portion or blow-by gas entry opening 58 situated upwardly of the distributing space 56.

The intercepting plates 55-1 to 55-4 are provided in contact with or in proximity to the inner wall 59*a* of the inlet muffling case 59 (FIG. 3), so as to separate the interior of the muffler box into the right distributing space 56 and left air passage space 57. The intercepting plates 55-1 to 55-4 are spaced apart from each other to form several blow-by gas distributing paths S1 to S5 corresponding to the air horns 53-1 to 53-4. Specifically, the path S1 is formed in the vicinity of the lower right corner portion of the air horn 53-1 between the the uppermost intercepting plate 55-1 and adjoining "downstream" (as defined by the direction in which the blow-by gas G (FIG. 5) introduced via the connector portion 58 flows in the space 56) intercepting plate 55-2, and the path S2 is formed in the vicinity of the upper right corner portion of the air horn 53-2 between the intercepting plate 55-2 and adjoining downstream intercepting plate 55-3. Similarly, the path S3 is formed in the vicinity of the upper right corner portion of the air horn 53-3 between the intercepting plate 55-3 and adjoining downstream intercepting plate 55-4. The path S4 is formed between the upper right corner portion of the air horn 53-4 and intercepting plate 55-4, and the path S5 is formed in the vicinity of the lower right corner portion of the air horn 53-4.

The intercepting plates 55-1 to 55-4 may be of any desired shape, but most importantly, the paths S1 to S5 have different sizes that become progressively greater as their distances from the connector portion 58 increase. More specifically, each of the distributing paths located downstream of one or more other distributing paths is greater in vertical size than the other distributing paths. Thus, the path S1 closest to the connector portion 58 has the smallest size, whereas the path S5 farthest away from the connector portion 58 has the greatest size. The progressively increasing sizes of the blow-by gas distributing paths S1 to S5 will serve to prevent the blow-by gas from flowing concentratedly through the path S1 into the intake passage 53-1 closest to the connector portion (entry opening) 58.

In this way, the entry opening 58, distributing paths S1 to S5 and intake passages 53-1 to 53-4 of the inlet muffler box 50 and the throttle valve devices 61 together define a structure for returning the blow-by gas to an upstream portion of the engine intake system.

A description will be made below on the operation of the thus-arranged vertical-type multicylinder engine 3.

Referring to FIG. 2, air necessary for combustion is introduced into each carburetor 62 of FIG. 3 through the inlet muffler box 50, while fuel is introduced into each carburetor 62 through the corresponding fuel pump 72 and fuel supplying tube 73. Then, the resultant air-fuel-mixture is sucked into the combustion chamber 21*a* via the intake manifold branch pipe 65 and cylinder head passageway 24*a* as shown in FIG. 3.

The operation of the blow-by gas returning structure will be described next with reference to FIGS. 2, 3 and 5. In FIG. 2, a proportion of combusted gas having leaked from the individual combustion chambers through gaps between the respective pistons and cylinders is directed into the valve operating chamber 25*a* and then to the connector portion 58 of the base 51 via the blow-by gas returning tube 67 of FIG. 3.

Figure 5:
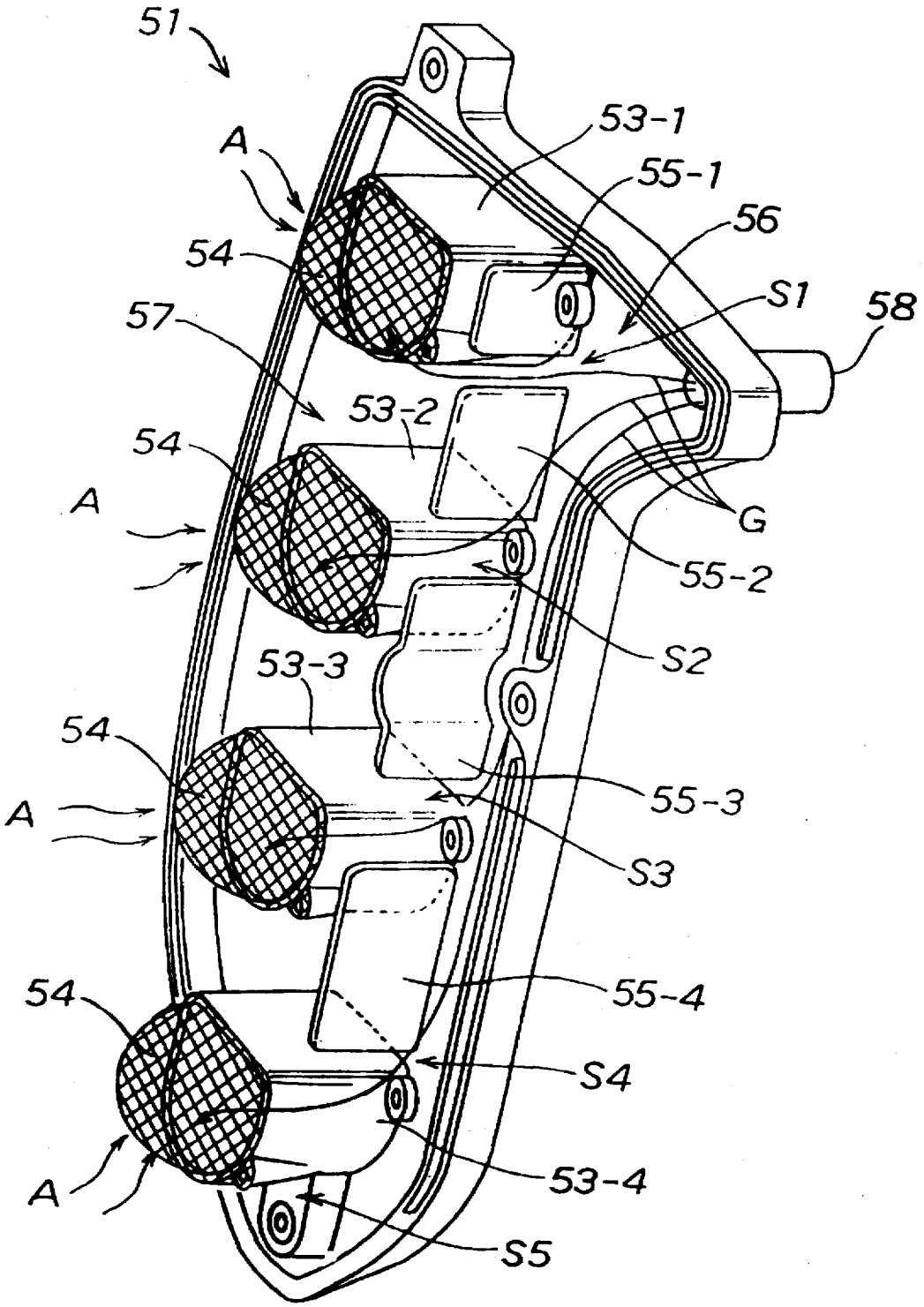
FIG. 5 is a schematic perspective view explanatory of the operation of the inlet muffler box of FIG. 4.

FIG. 5 is a schematic view explanatory of the operation of the inlet muffler box in accordance with the present invention.

The blow-by gas G introduced through the connector portion 58 into the distributing space 56 is sequentially intercepted by the intercepting plates 55-1 to 55-4 while flowing in the space 56, so as to distributively escape through the paths S1 to S5 to the individual intake passages 53*a* (FIG. 4). In this way, the distributing space 56 allows the blow-by gas G to flow into the individual intake passages 53*a* in substantially uniform amounts. The air A introduced via the muffling case 59 (FIG. 3) into the air passage space 57 is also allowed to flow into the individual intake passages 53*a* in substantially uniform amounts. Consequently, the mixture ratios of the air A and blow-by gas G flowing into the individual intake passages 53*a* can generally be normalized, with the result that the densities of the blow-by gas G returning to the individual combustion chambers 21*a* via the respective throttle valve devices 61 and intake systems can also generally be normalized. The blow-by gas G thus returned into each combustion chamber 21*a* is ultimately subjected to re-combustion therein.

Figure 6:
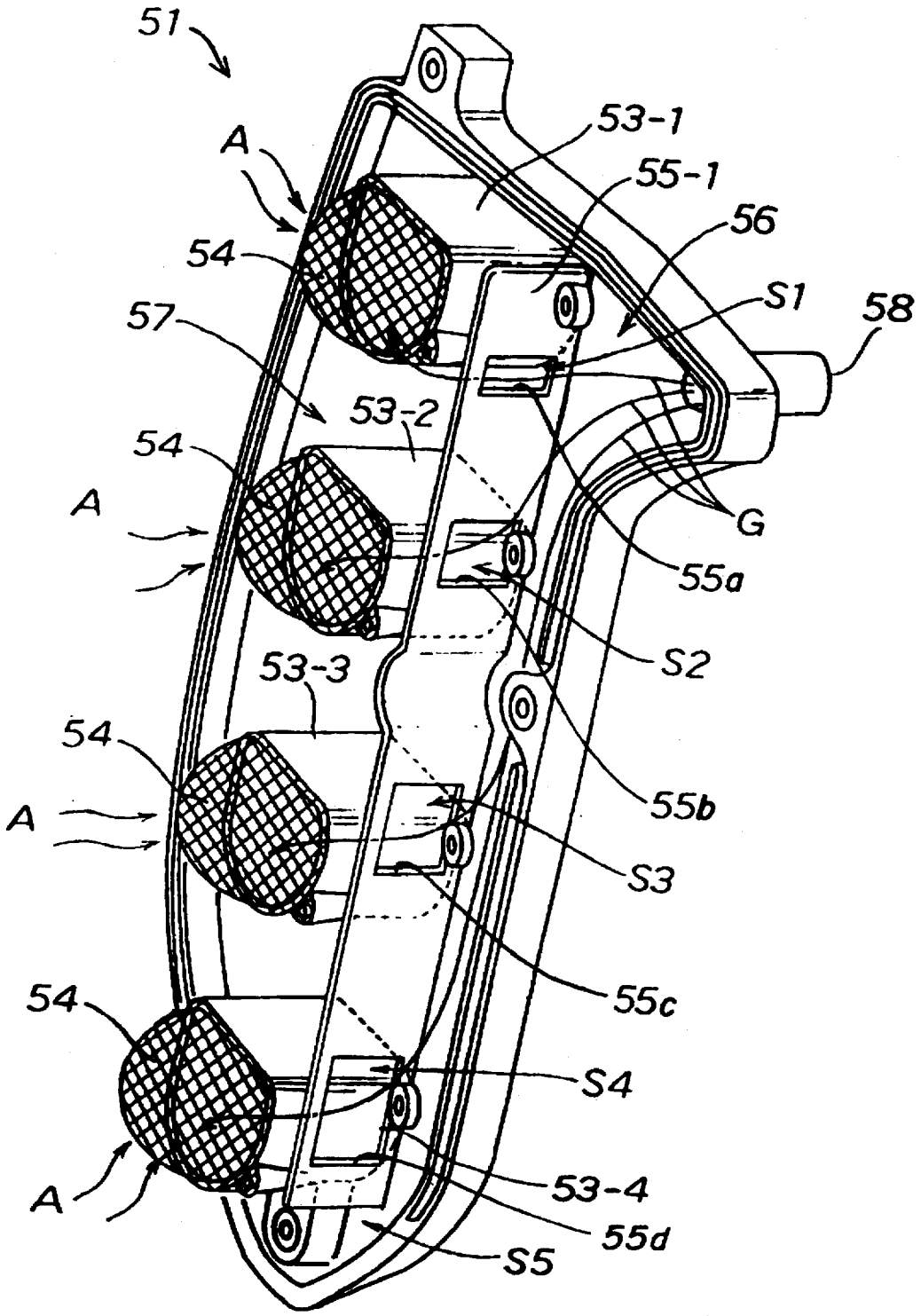
FIG. 6 is a view similar to FIG. 5 but showing an alternative embodiment of the present invention.

In an alternative embodiment shown in FIG. 6, the distributing paths S1–S4 may be formed by a single intercepting plate 55, rather than by the plural intercepting plates as described above, having a plurality of holes 55*a*, 55*b*, 55*c* and 55*d* formed therein so that the holes 55*a*–55*d* define the distributing paths S1–S4.

The following advantageous results are achieved by the above-mentioned features of the present invention:

Because the paths for distributing the blow-by gas to the plural throttle valve devices are provided within the inlet muffler, it is possible to minimize inter-cylinder differences in the amounts of blow-by gas flowing into the individual throttle valve devices.

Further, because the distributing paths formed by one or more intercepting plates have different sizes that become progressively greater as the the paths are located farther away from the blow-by gas entry opening, it is possible to prevent the blow-by gas, introduced into the muffler, from flowing concentratedly through one of the paths which is closest to the entry opening, and hence uniform amounts of the blow-by gas are allowed to flow through the individual blow-by gas distributing paths. Thus, the blow-by gas introduced into the muffler, while flowing along the intercepting plate or plates, is allowed to distributively pass through the distributing paths into the corresponding throttle valve devices in substantially uniform amounts. This arrangement can further contribute to minimization of the inter-cylinder differences in combustion conditions.

What is claimed is:

1. A vertical-type multicylinder engine comprising:

a plurality of combustion chambers;

an inlet muffler having a plurality of air intake passages and a blow-by gas entry opening for introducing a blow-by gas into said muffler; and a plurality of throttle valve devices disposed downstream of said intake passages and upstream of said combustion chambers in corresponding relation thereto, said inlet muffler having a plurality of blow-by gas distributing paths formed inside said muffler in correspondence to said throttle valve devices, said blow-by gas distributing paths being designed to allow passage of a substantially uniform amount of the blow-by gas introduced via said entry opening so that said blow-by gas is distributed in substantially uniform amount to respective ones of said throttle valve devices, said entry opening, distributing paths and intake passages of said muffler and said throttle valve devices jointly defining a structure for returning the blow-by gas to an upstream portion of an intake system of said engine.

2. A vertical-type multicylinder engine according to claim 1, wherein said distributing paths are defined by a plurality of intercepting plates that are provided in spaced apart relation to each other inside said muffler, gaps between adjacent said plates defining said distributing paths.

3. A vertical-type multicylinder engine according to claim 2, wherein said distributing paths have different sizes that become progressively greater as said paths are located farther away from said blow-by gas entry opening.

4. A vertical-type multicylinder engine according to claim 1, wherein said distributing paths are different in vertical size.

5. A vertical-type multicylinder engine according to claim 4, wherein said distributing paths are sized such that each said distributing path located downstream of any other said distributing path is greater in vertical size than said other distributing path.

6. A vertical-type multicylinder engine comprising:

a plurality of combustion chambers;

an inlet muffler composed of a base and an inlet muffling case mounted on said base and defining jointly with said base an internal space of said inlet muffler, said inlet muffler having a plurality of air intake passages provided in said base, and a blow-by gas entry opening provided in said base for introducing a blow-by gas into said muffler; and a plurality of throttle valve devices disposed downstream of said intake passages and upstream of said combustion chambers in corresponding relations thereto, said inlet muffler having a plurality of blow-by gas distributing paths, formed inside said muffler in correspondence to said throttle valve devices, for allowing the blow-by gas introduced via said entry opening to distributively flow therethrough into respective ones of said throttle valve devices, said entry opening, distributing paths and intake passages of said muffler and said throttle valve devices jointly defining a structure for returning the blow-by gas to an upstream portion of an intake system of said engine, said distributing paths being defined by a plurality of intercepting plates that are provided in spaced apart relations to each other inside said muffler, gaps between adjacent said plates defining said distributing paths, said intercepting plates being disposed on one side of said air intake passages and located between said blow-by gas entry opening and said air intake passages, so as to separate said internal space of said inlet muffler into a first space to which said blow-by gas entry opening opens, and a second space to which said air intake passages open, said blow-by gas entry opening communicating with said air intake passages via said distributing paths.

7. A vertical-type multicylinder engine comprising:

a plurality of combustion chambers:

an inlet muffler having a plurality of air intake passages and a blow-by gas entry opening for introducing a blow-by gas into said muffler; and a plurality of throttle valve devices disposed downstream of said intake passages and upstream of said combustion chambers in corresponding relation thereto, said inlet muffler having a plurality of blow-by gas distributing paths formed inside said muffler in correspondence to said throttle valve devices, said blow-by gas distributing paths being designed to allow passage of a substantially uniform amount of the blow-by gas introduced via said entry opening so that said blow-by gas is distributed in substantially uniform amount to respective ones of said throttle valve devices, said entry opening, distributing paths and intake passages of said muffler and said throttle valve devices jointly defining a structure for returning the blow-by gas to an upstream portion of an intake system of said engine, wherein said distributing paths are defined by a single intercepting plate having a plurality of holes formed therein, said holes defining said distributing paths.

8. A vertical-type multicylinder engine according to claim 7, wherein said distributing paths are different in vertical size.

* * * * *